US007824067B2

(12) United States Patent
Martineau et al.

(10) Patent No.: US 7,824,067 B2
(45) Date of Patent: Nov. 2, 2010

(54) EMERGENCY LIGHT FIXTURE HAVING AN EFFICIENT REFLECTOR ASSEMBLY

(75) Inventors: Patrick Martineau, Ile-Perrot (CA); Radu Cornel Rapeanu, Mont-Royal (CA)

(73) Assignee: Thomas & Betts International, Inc., Wilmington, DE (US)

( * ) Notice: Subject to any disclaimer, the term of this patent is extended or adjusted under 35 U.S.C. 154(b) by 326 days.

(21) Appl. No.: 11/935,450

(22) Filed: Nov. 6, 2007

(65) Prior Publication Data

US 2008/0232102 A1 Sep. 25, 2008

Related U.S. Application Data

(60) Provisional application No. 60/896,015, filed on Mar. 21, 2007.

(51) Int. Cl.
*F21V 7/00* (2006.01)

(52) U.S. Cl. ..... 362/247; 362/296.08; 362/297; 362/346

(58) Field of Classification Search ..... 362/241, 362/247, 297, 296.08, 346, 517, 518, 544
See application file for complete search history.

(56) References Cited

U.S. PATENT DOCUMENTS 1,861,883 A * 6/1932 Russell, Jr. ..... 362/235
4,047,020 A 9/1977 Noren
4,432,041 A 2/1984 Pfisterer et al.
4,895,814 A 1/1990 Kanzaki et al.
4,985,814 A 1/1991 Lyons
5,117,336 A 5/1992 Scenzi
5,140,504 A 8/1992 Sato
5,249,110 A 9/1993 Russello et al.
D468,046 S 12/2002 Bernard et al.
6,761,475 B2 7/2004 Perlo et al.
7,147,348 B2 12/2006 Heaton et al.

OTHER PUBLICATIONS

Emergency Systems, Lithonia Lighting, www.lithonia.com/products/ProductType2.asp?Brand=LL&ProductType=Emergency%20-Lighting, pp. 1-2 (2007).
Cooper Lighting—Sure Lites®, Architectural Emergency Light Series, Cooper Lighting, pp. 1-2 (2007).
Patron™ Series Architectural Die Cast Unit, McPhilben, p. 524 (2007).
309 Series Lightscaper, HID/Incandescent Lamp Holders, Security Lighting System, Hubbell Lighting, Inc., pp. 1-2 (2007).

* cited by examiner

*Primary Examiner*—Stephen F Husar
(74) *Attorney, Agent, or Firm*—Hoffmann & Baron, LLP

(57) ABSTRACT

A reflector includes a first concave surface, a second concave surface and a third concave surface. The first concave surface has a first axis and a first opening to receive a first light source. The first concave surface is configured to reflect first light rays of the first light source from the first concave surface across the first axis and not to reflect second light rays of the first light source from the first concave surface. The second concave surface has a second axis and a second opening to receive a second light source. The second concave surface is configured to reflect first light rays of the second light source from the second concave surface across the second axis and not to reflect second light rays of the second light source from the second concave surface. The third concave surface translates along a substantially straight line to intersect the first concave surface and the second concave surface such that the first light rays of the first and second light sources contribute to an interior lighted portion of a lighted pathway that is defined by a combination of the first and second light rays of the first and second light sources.

24 Claims, 14 Drawing Sheets

19c

19c

EMERGENCY LIGHT FIXTURE HAVING AN EFFICIENT REFLECTOR ASSEMBLY

CROSS-REFERENCE TO RELATED APPLICATION

This application claims the benefit of U.S. Provisional Patent Application No. 60/896,015 filed Mar. 21, 2007, the disclosure of which is incorporated herein by reference.

BACKGROUND OF THE INVENTION

1. Field of the Invention

The present invention generally relates to emergency lighting fixtures. In particular, the present invention provides for an improved reflector for use in emergency lighting fixtures.

2. Description of the Related Art

Typically, emergency lighting fixtures 10 include two lamps, each of which can be adjusted to a desired direction, as shown in FIG. 11. The end users then adjust the lamps 10 as best they can to obtain uniform illumination on the floor. However, the resulting illumination is often inconsistent and the light pattern 12 of these units is incompatible with typical paths of egress 14.

Alternative solutions, which include emergency lights with a reflector specifically dedicated for corridors or hallways, have been developed. Some emergency lighting fixtures, found in the prior art, use an adjustable system with two (2) lamps and two (2) optical cavities, as described in U.S. Pat. No. 7,147,348 to Heaton et al., which is incorporated herein by reference. Other fixtures develop systems that combine very efficient lenses (refraction) with inefficient reflectors, while the use of refraction in the lens results in the loss of light. Some fixtures, in an effort to meet the requirements of the specification, include an inefficient reflector/refractor with more lamps which results in a larger unit with lower efficiency.

In the automotive industry, for example, headlight designers must develop two (2)-lamp reflectors that generate the same type of light patterns. Such lamps are in independent cavities, as described in U.S. Pat. No. 5,117,336 to Scenzi; U.S. Pat. No. 5,140,504 to Cheney et al.; and U.S. Pat. No. 4,895,814 to Kanzaki et al., which are incorporated herein by reference, resulting in larger reflectors. Some of these fixtures have control in only one direction, usually in the vertical, but rarely in both the vertical and horizontal directions.

SUMMARY OF THE INVENTION

In accordance with an embodiment, a light fixture is disclosed. The light fixture includes a reflector, a first light source and a second light source. The reflector includes a first concave surface having a first axis, a second concave surface having a second axis and a third concave surface that translates along a substantially straight line to intersect the first concave surface and the second concave surface. The first light source is disposed within the reflector in proximity to the first axis to provide a plurality of first light rays, such that a first portion of the first light rays is reflected from the first concave surface across the first axis and a second portion of the first light rays is not reflected from the first concave surface. The second light source is disposed within the reflector in proximity to the second axis to provide a plurality of second light rays, such that a first portion of the second light rays is reflected from the second concave surface across the second axis and a second portion of the second light rays is not reflected from the second concave surface. The first portion of the first light rays and the first portion of the second light rays contribute to an interior lighted portion of a lighted pathway that is defined by a combination of the first light rays and the second light rays.

In accordance with another embodiment, a reflector is disclosed. The reflector includes a first concave surface, a second concave surface and a third concave surface. The first concave surface has a first axis and a first opening to receive a first light source. The first concave surface is configured to reflect first light rays of the first light source from the first concave surface across the first axis and not to reflect second light rays of the first light source from the first concave surface. The second concave surface has a second axis and a second opening to receive a second light source. The second concave surface is configured to reflect first light rays of the second light source from the second concave surface across the second axis and not to reflect second light rays of the second light source from the second concave surface. The third concave surface translates along a substantially straight line to intersect the first concave surface and the second concave surface such that the first light rays of the first and second light sources contribute to an interior lighted portion of a lighted pathway that is defined by a combination of the first and second light rays of the first and second light sources.

In accordance with a further embodiment, a method of manufacturing a reflector is disclosed. The method includes providing a first concave that has a first axis and a first opening to receive a first light source in proximity to the first axis, such that the first concave surface reflects first light rays of the first light source from the first concave surface across the first axis and does not reflect second light rays of the first light source from the first concave surface. The method also includes providing a second concave surface that has a second axis and a second opening to receive a second light source in proximity to the second axis, such that the second concave surface reflects first light rays of the second light source from the second concave surface across the second axis and does not to reflect second light rays of the second light source from the second concave surface. The method further includes providing a third concave surface that translates along a substantially straight line to intersect the first concave surface and the second concave surface, such that the first light rays of the first and second light sources contribute to an interior lighted portion of a lighted pathway that is defined by a combination of the first and second light rays of the first and second light sources.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
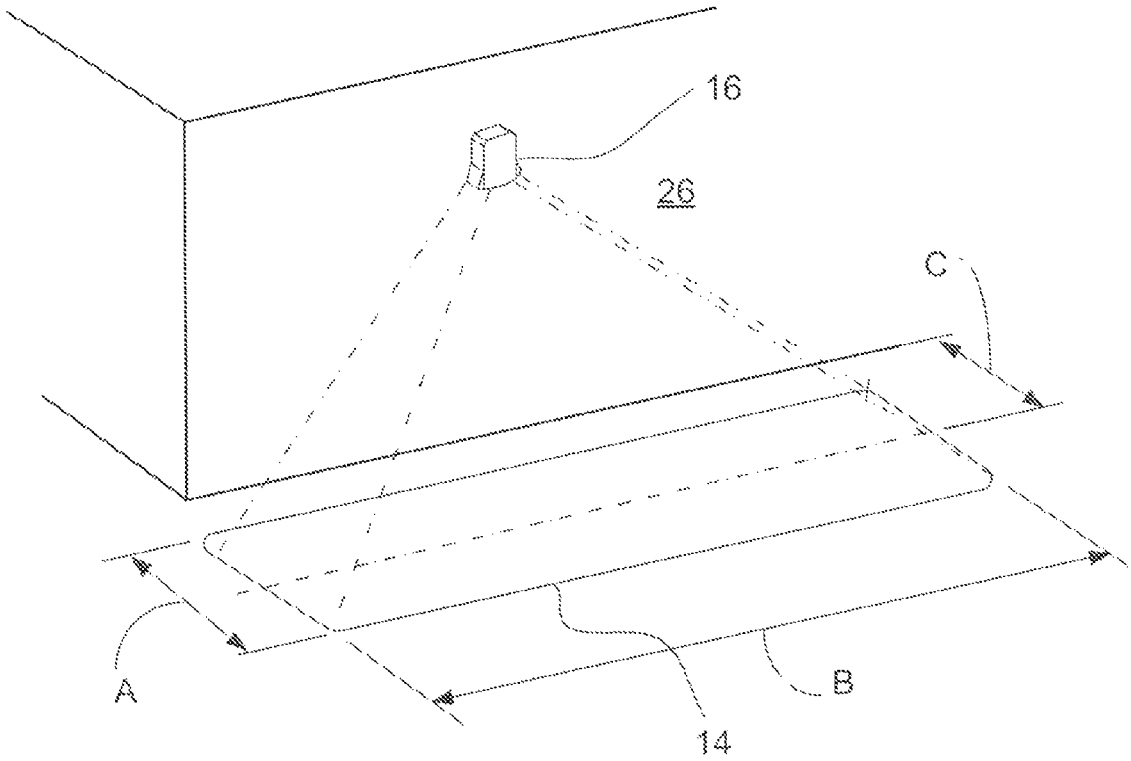
FIG. 1 shows an emergency light fixture in accordance with the present invention installed on a wall and a path of egress to be illuminated.

The present invention is directed to an emergency light fixture 16, as shown in FIG. 1, which includes a compact and efficient reflector. The purpose of the emergency light fixture 16 is to illuminate a path of egress 14 during emergency evacuation. Usually, paths of egress are long and narrow, and have a width of three (3) to six (6) feet, and a length as long as seventy (70) feet, such as that of a corridor or hallway, shown in FIG. 1. The design of the reflector, in accordance with the present invention, is adapted to a corridor/hallway-type of path.

There is a demand in the marketplace to improve the integration of emergency light fixtures with existing architectural structures, such that their visual impact is reduced. The emergency light fixture 16, in accordance with the present invention, addresses this growing need in two ways. First, the emergency light fixture 16 significantly improves optical efficiency, which translates into fewer units that need to be installed. Second, the overall size of an installed unit is significantly reduced by the use of a compact reflector.

The emergency light fixture 16, in accordance with the present invention, includes two light sources contained in emergency lighting that are incorporated in the same optical cavity. This configuration does not compromise the control of a light pattern, and substantially reduces the reflector size. The two light sources address the redundancy requirement specific to emergency lighting. The light control is excellent in both directions, i.e. the length and the width, of the path to be illuminated. The emergency light fixture 16 of the present invention is adapted to illuminate narrow paths of egress, such as the corridor shown in FIG. 1.

Figure 4A:
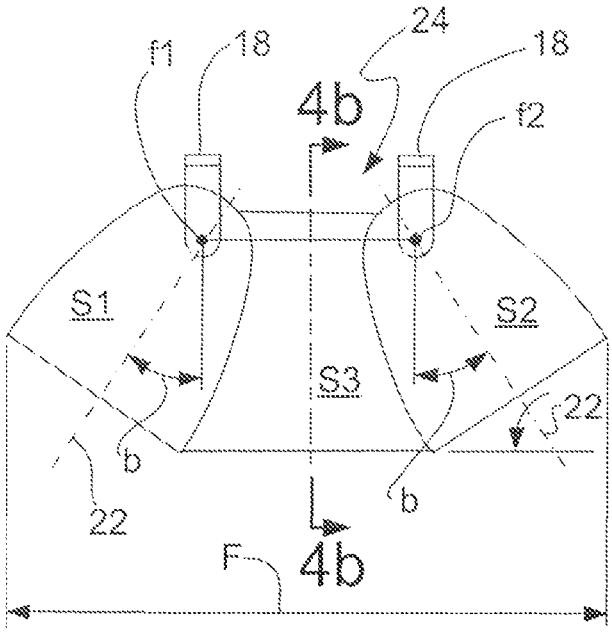
FIG. 4*a* shows a front view of the reflector of the emergency light fixture.

A reflector 24 preferably includes three concave surfaces S1, S2, and S3, shown in FIG. 4*a*, which are generated by parabolic curves. Two of the surfaces, S1 and S2, preferably have the shape of a parabolic cone, which is developed by rotation of a parabola about its central axis 22. The cones preferably have their axes oriented at symmetrical angles b, shown in FIG. 4*a*. The third surface S3 is preferably a parabolic cylinder, which is developed by the translation of a parabola and the intersection of each of the cones described above, as shown in FIG. 4*b*.

Figure 5:
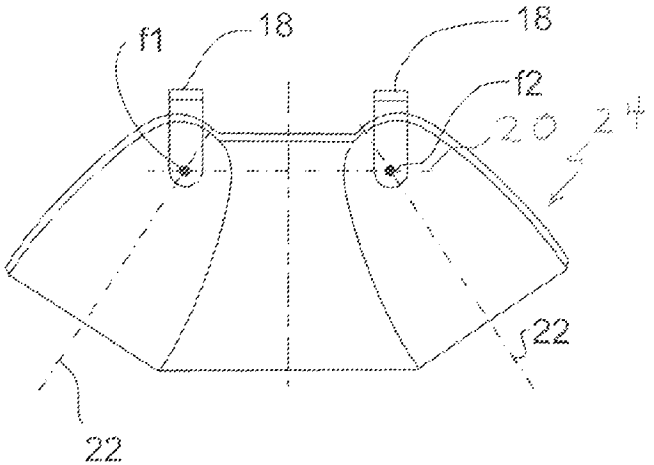
FIG. 5 shows a preferred filament alignment in the reflector.

The two lamps 18 are preferably positioned in the focus $f_1$ and $f_2$ of each cone. The lamps 18 preferably have their filaments aligned with a long horizontal axis 20 of the reflector, as shown in FIG. 5. The two cone axes 22 are preferably co-planar and have their plane tilted at a certain angle c, shown in FIG. 3*b*. This angle preferably controls the distance of the illuminated path from the wall on which the emergency fixture 16 is installed.

The resulting reflector surface preferably has only a concave shape with no convex joints, allowing the light emitted by each lamp 18 to reach any point of the reflector surface.

The orientation angle of the cone axes 22 preferably controls the length of the illuminated path of egress. The tilt angle of the axes plane b, shown in FIG. 2*b*, preferably controls the length of the illuminated path.

FIG. 1 shows the fixture 16 installed on a wall 26, with the mounting height preferably about eight (8) feet, and the path of egress to be illuminated. Width A is narrower than length B, and thus the ratio B/A can be as high as forty (40). With the reflector design of the present invention, both width A, length B, and position C can be controlled. Typically, controlling the light with refraction results in light loss. The emergency light fixture 16, in accordance with the present invention, is controlled with only a reflector, and thus is more efficient and can prevent light loss.

Figure 2A:
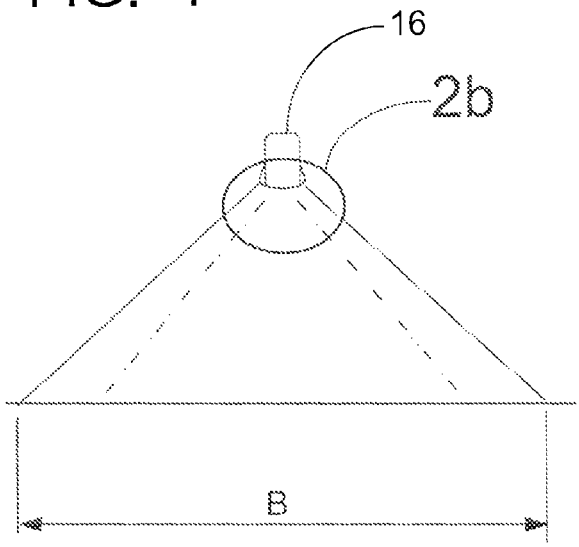
FIGS. 2*a* and 2*b* show a length of a light pattern of the emergency light fixture controlled by tilting a focal axis of its reflector.
Figure 2B:
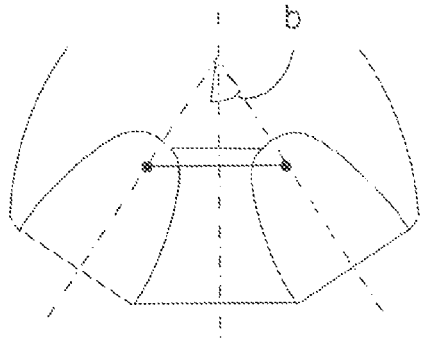

FIGS. 2*a* and 2*b* show the length of the light pattern preferably controlled by tilting the focal axis by b degrees.

Figure 3A:
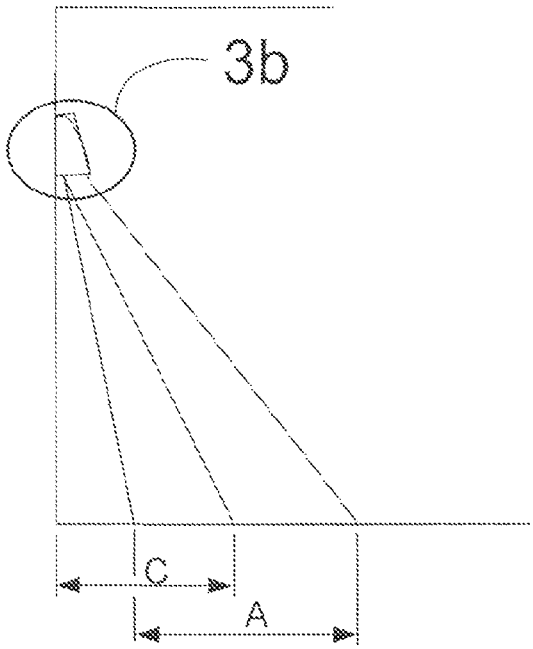
FIGS. 3*a* and 3*b* show a light pattern position C of the emergency light fixture controlled by tilting its reflector.
Figure 3B:
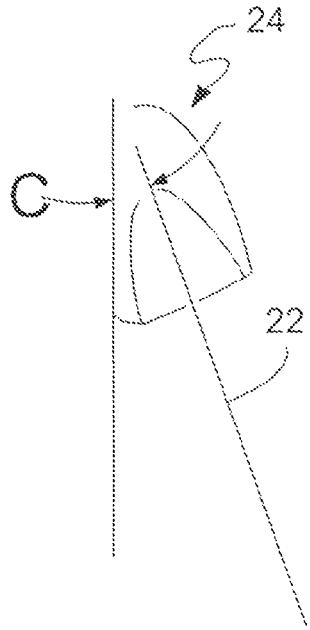

FIGS. 3*a* and 3*b* show the light pattern position C preferably controlled by tilting the reflector by c degrees.

FIG. 4*a* shows a front view of the reflector. Surfaces S1 and S2 are preferably generated by revolving a profile around the axis 22, as shown, to generate a cross-sectional profile. Surface S3 is obtained by extruding the same profile in an approximately linear path between surfaces S1 and S2. Further, the focal points $f_1$ and $f_2$ of the two light sources are also shown.

Figure 4B:
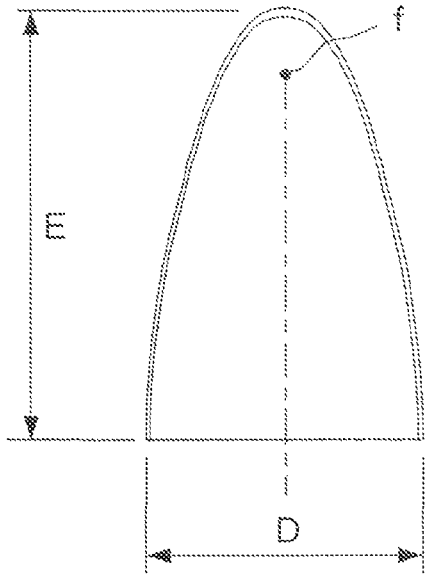
FIG. 4*b* shows a side view of the reflector.

FIG. 4*b* shows the overall size of the reflector, which typically presents a major design constraint.

FIG. 5 shows an incandescent bulb, or lamp, 18, which is the preferred light source for the reflector 24. Light Emitting Diodes (LEDs) or other compact light sources, however, can also be used while remaining within the scope of the present invention. FIG. 5 shows the lamps 18 with the preferred filament alignment. In the position illustrated, the image of the filament will have the same shape as the path of egress. FIG. 5 shows how compact the reflector 24 can be made.

Figures 6A, 6B, 6C, 6D:
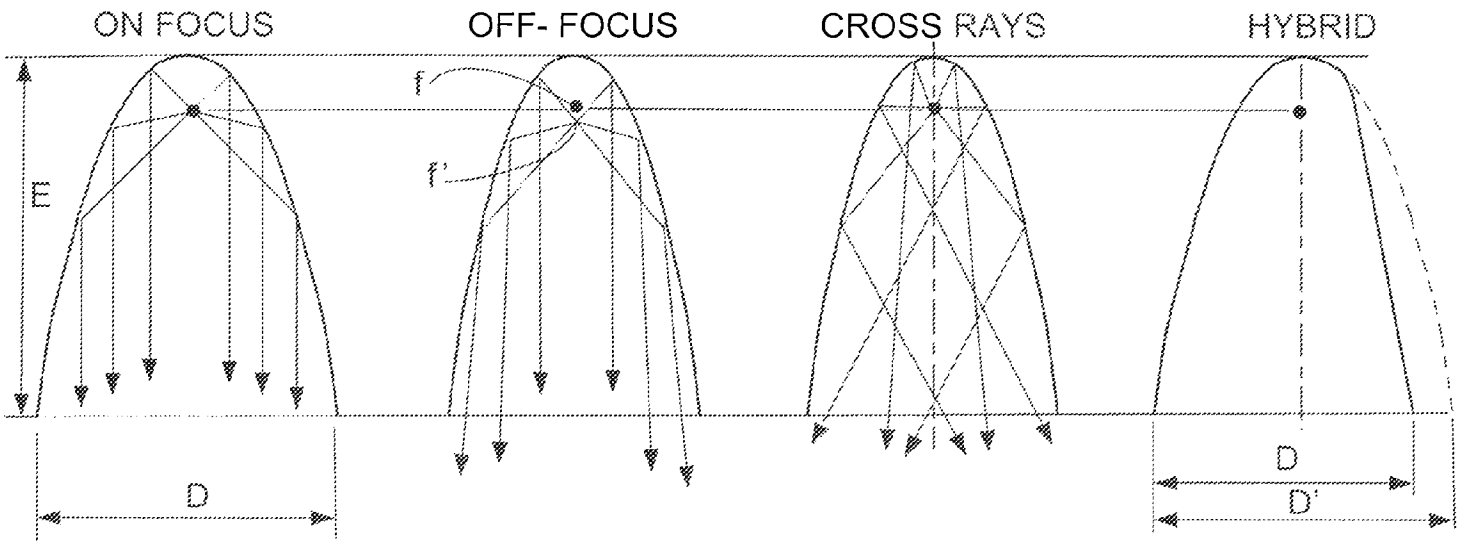
FIGS. 6*a*-6*d* show various profiles than can be used to control light distribution.

FIGS. 6*a*-*d* show various profiles that can be used to control the light distribution in width direction A of FIG. 1. Each of the profiles preferably has the same dimensional limitations D and E. FIG. 6*a* shows a perfect collimator, which will generate a narrow beam, typically too narrow for emergency lighting. FIG. 6*b* shows a light off-focus, which results in a fairly narrow and intense section surrounded by a wider, dimmed section. FIG. 6*c* shows a design approach in which the profile is optimized to obtain a uniform distribution. In this approach, the rays cross the optical axis, resulting in a more efficient profile for given dimensional constraints D and E. This is the preferred embodiment with which a precise control can be obtained. FIG. 6*d* shows a hybrid design, which has a symmetrical profile such as that shown in FIGS. 6*a*, 6*b*, and 6*c*, and has been cut by a plane in order to fit within dimension D. The drawback of such design is that the flat surface, or plane, is less efficient.

Figure 7A:
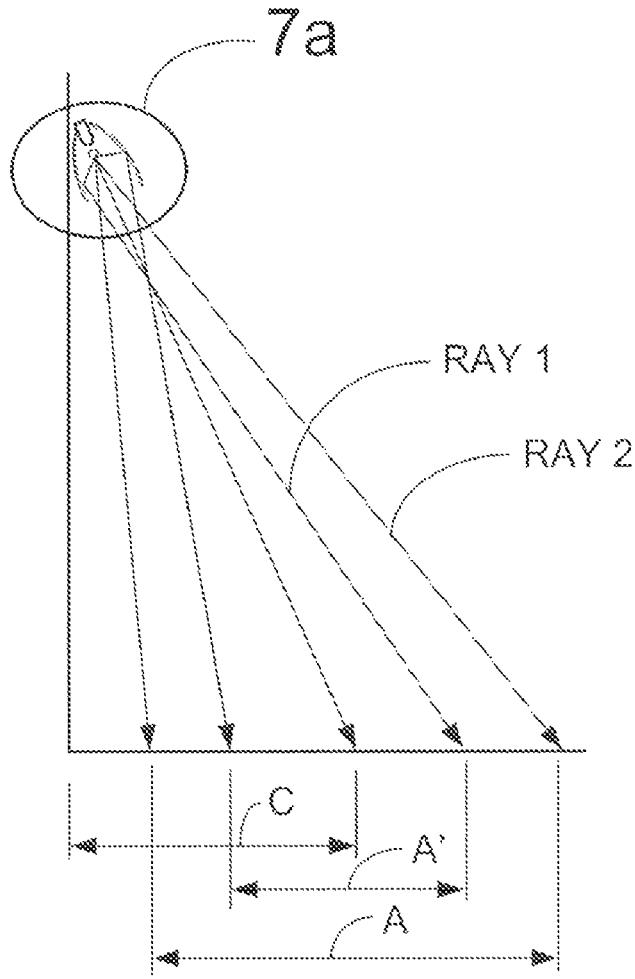
FIGS. 7*a* and 7*b* show how the distribution in a direction A works with the contribution of various rays.
Figure 7B:
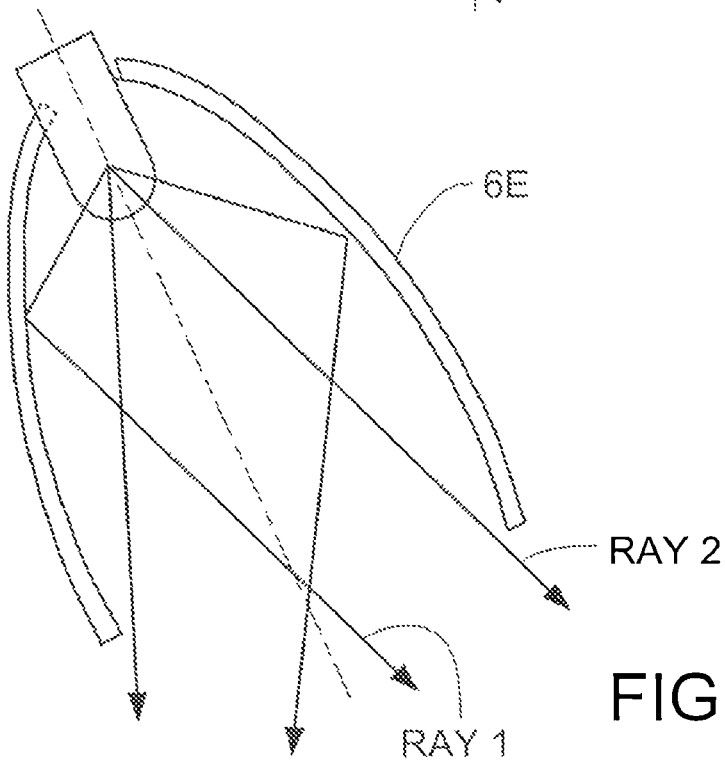

FIG. 7*a* shows a similar concept as FIG. 3, but further illustrates, in detail, how the distribution in direction A works with the contribution of various rays. FIG. 7*b* shows a close-up of this concept. Preferably, all rays that hit the reflector surface, such as Ray 1, are redirected within area A', yet the rays that are not reflected, such as Ray 2, are not lost, but preferably remain within area A. The result is an efficient reflector, in which all the rays are redirected within the path of egress.

Figure 8A:
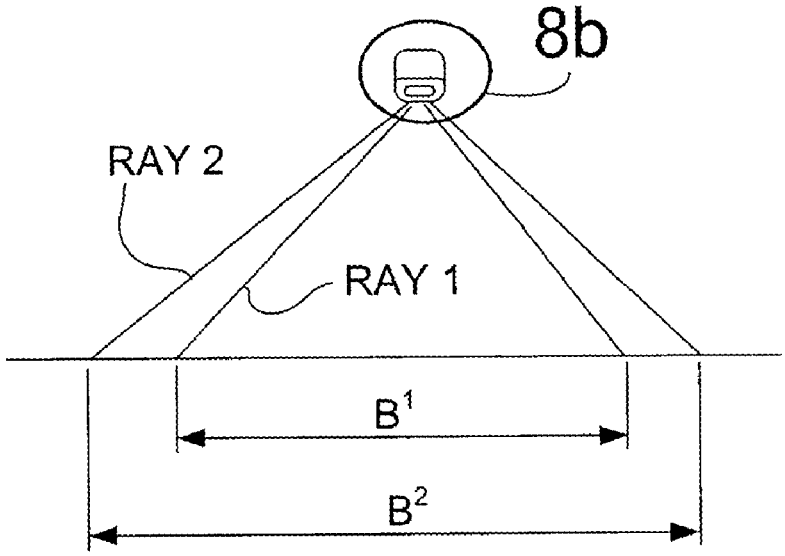
FIGS. 8*a* and 8*b* show the length of the path, the same distribution shown in FIGS. 7*a* and 7*b*.
Figure 8B:
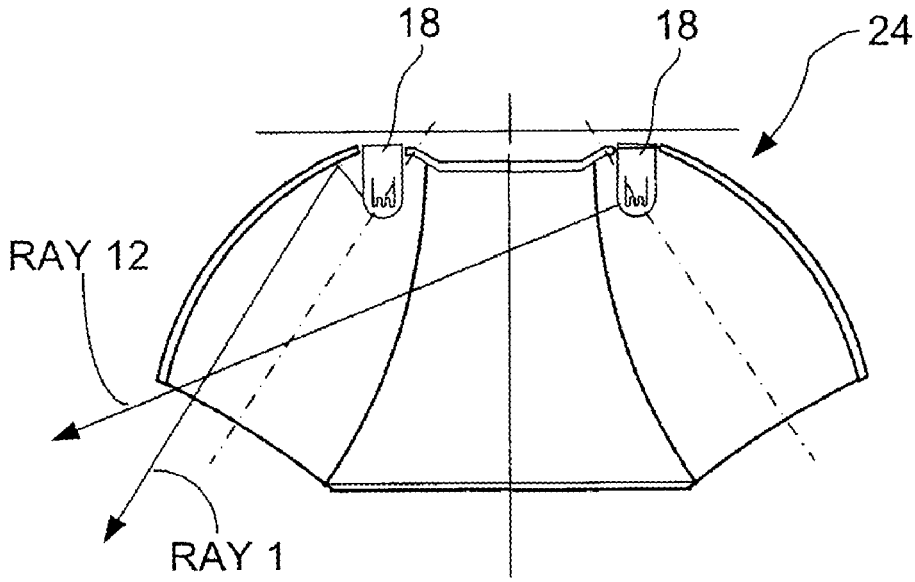

FIGS. 8*a* and 8*b* show the length of the path, the same distribution is shown in FIGS. 7*a* and 7*b*.

Figure 9:
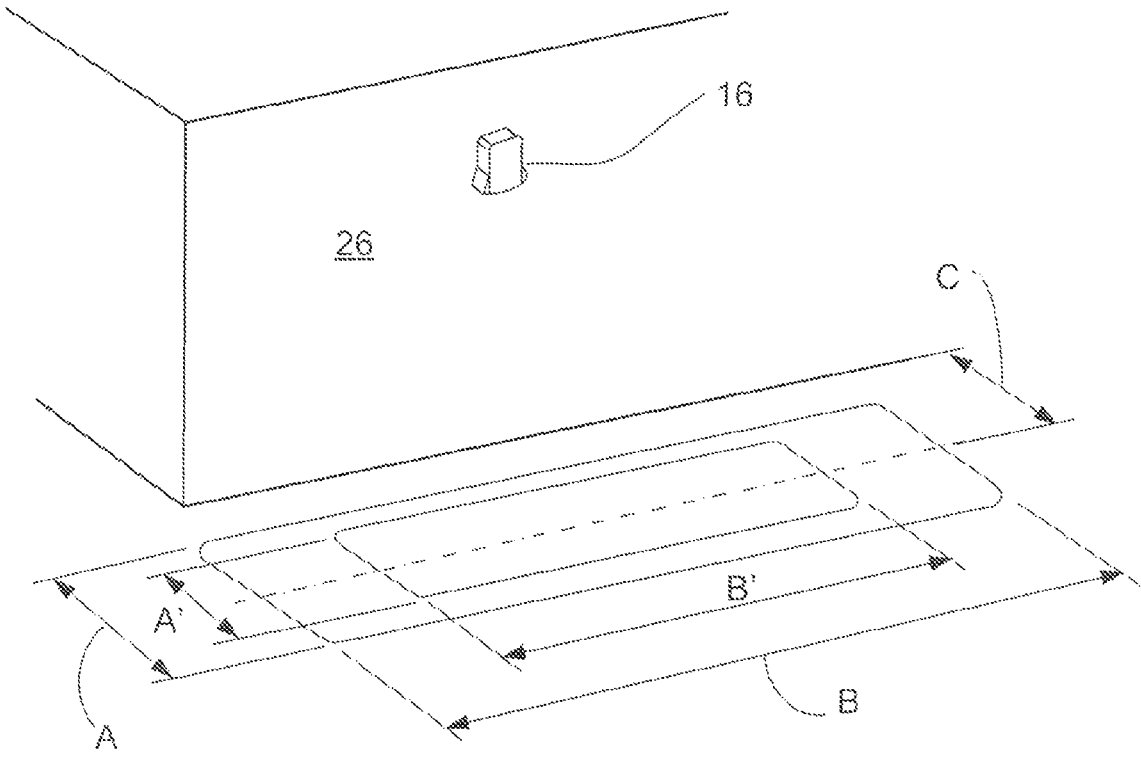
FIG. 9 shows an isometric view of a path of egress, the contribution of reflected rays (A'×B'), and the combination of both direct and reflected rays (A×B).

FIG. 9 shows an isometric view of the path of egress, the contribution of the reflected rays (A'×B'), and the combination of both direct and reflected rays (A×B).

Figure 10:
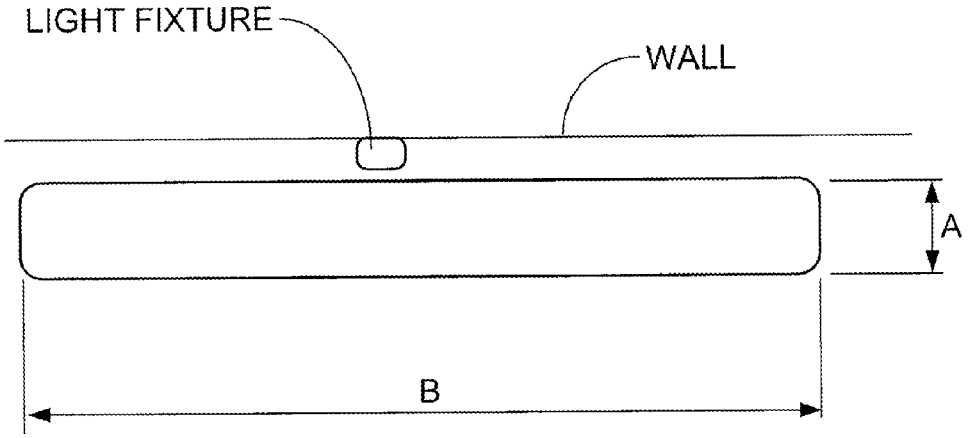
FIG. 10 shows an asymmetrical illuminated path.

FIG. 10 shows how asymmetrical the illuminating path can be, by illustrating that the length B of the path can be three (3) to forty (40) times the width A of the path.

Figure 11:
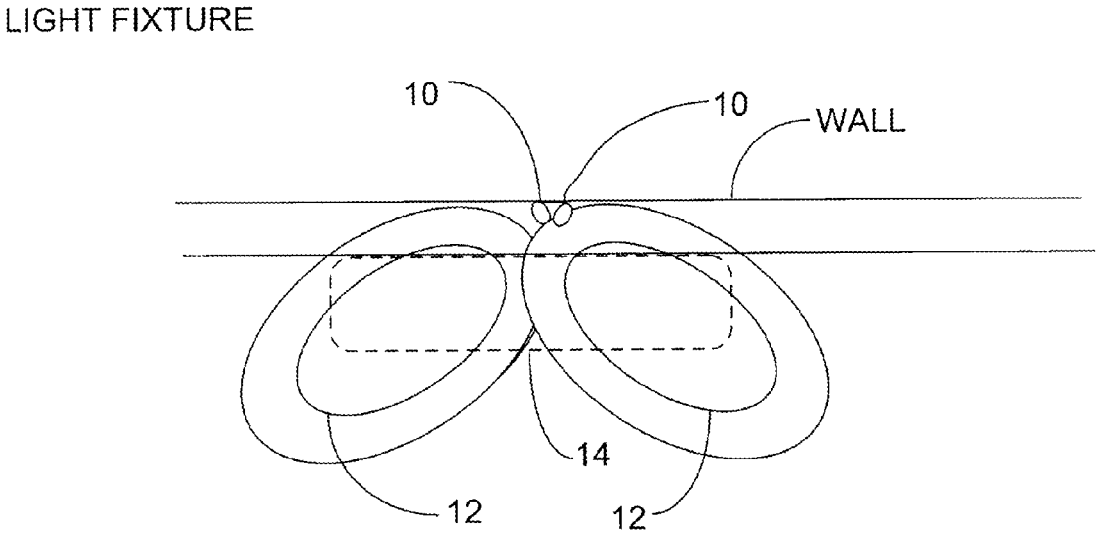
FIG. 11 shows how typical emergency lighting units work.
Figure 12:
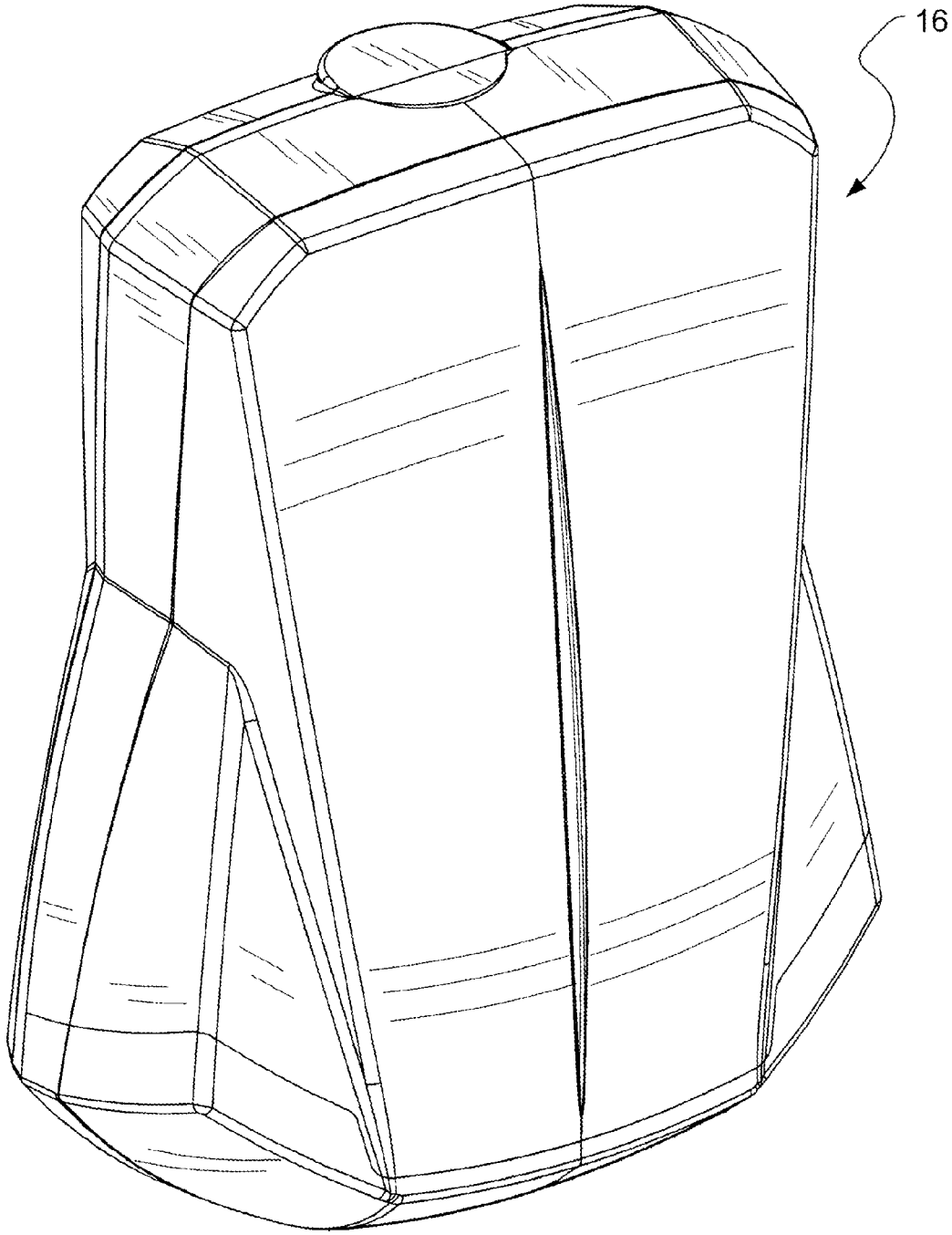
FIGS. 12 to 15 show how the present invention has been integrated in the emergency light fixture, in accordance with the present invention.
Figure 13:
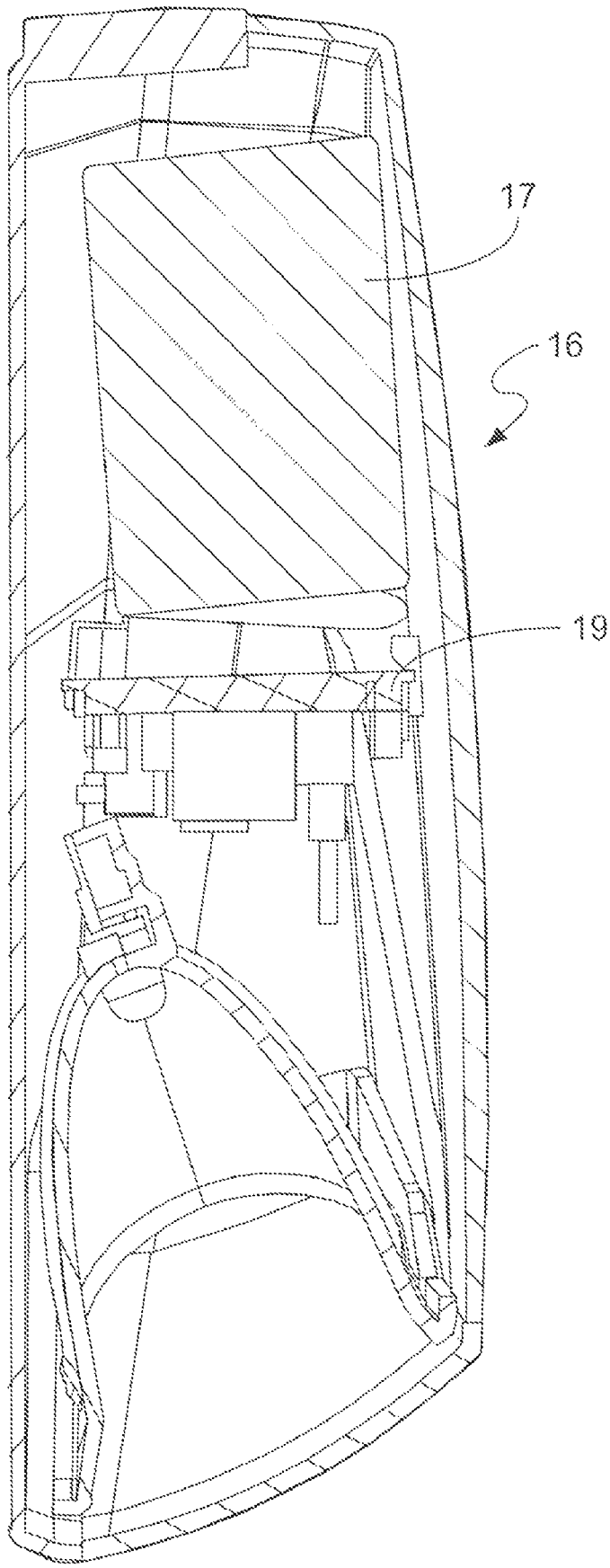
Figure 14:
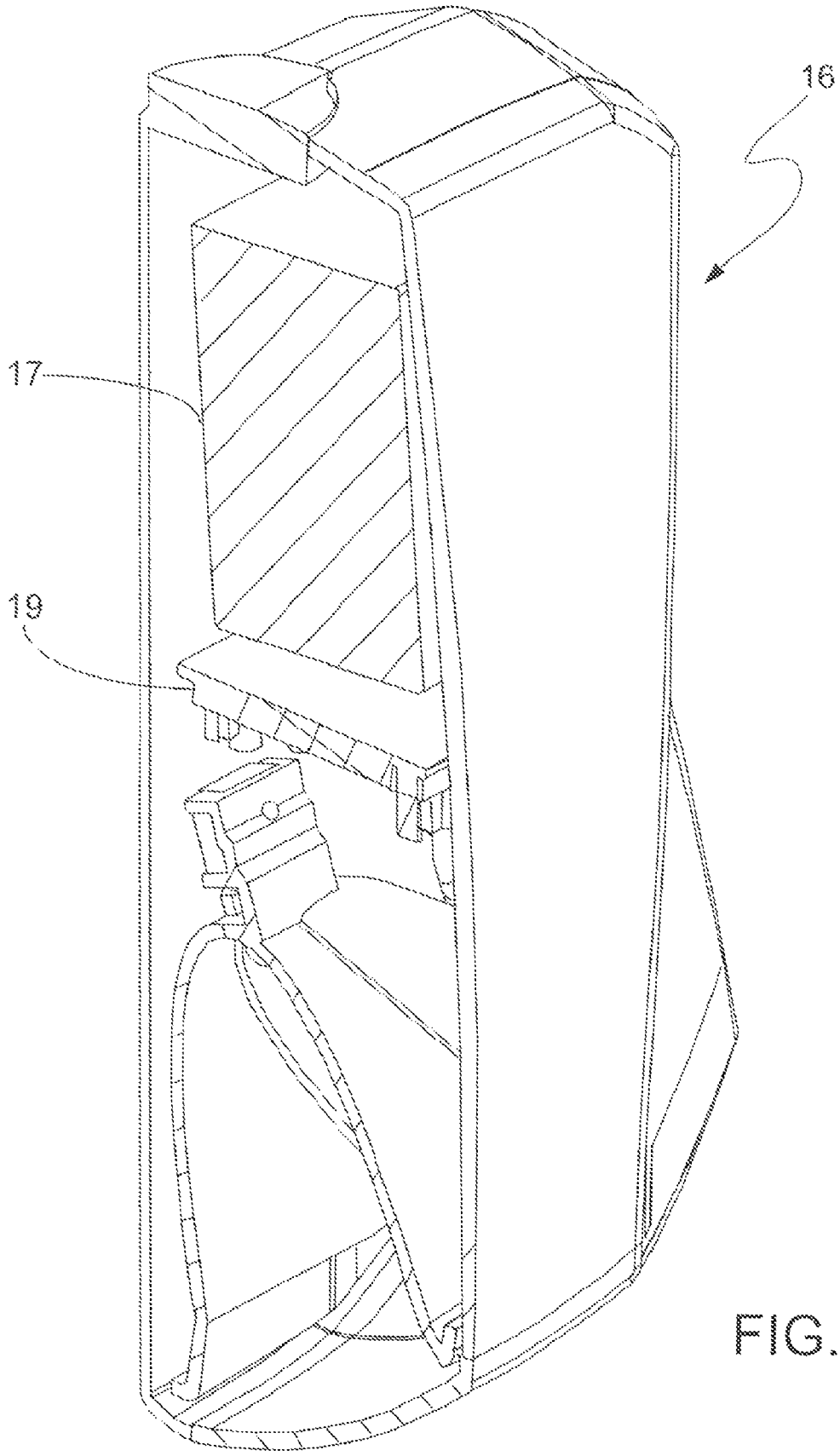
Figure 15:
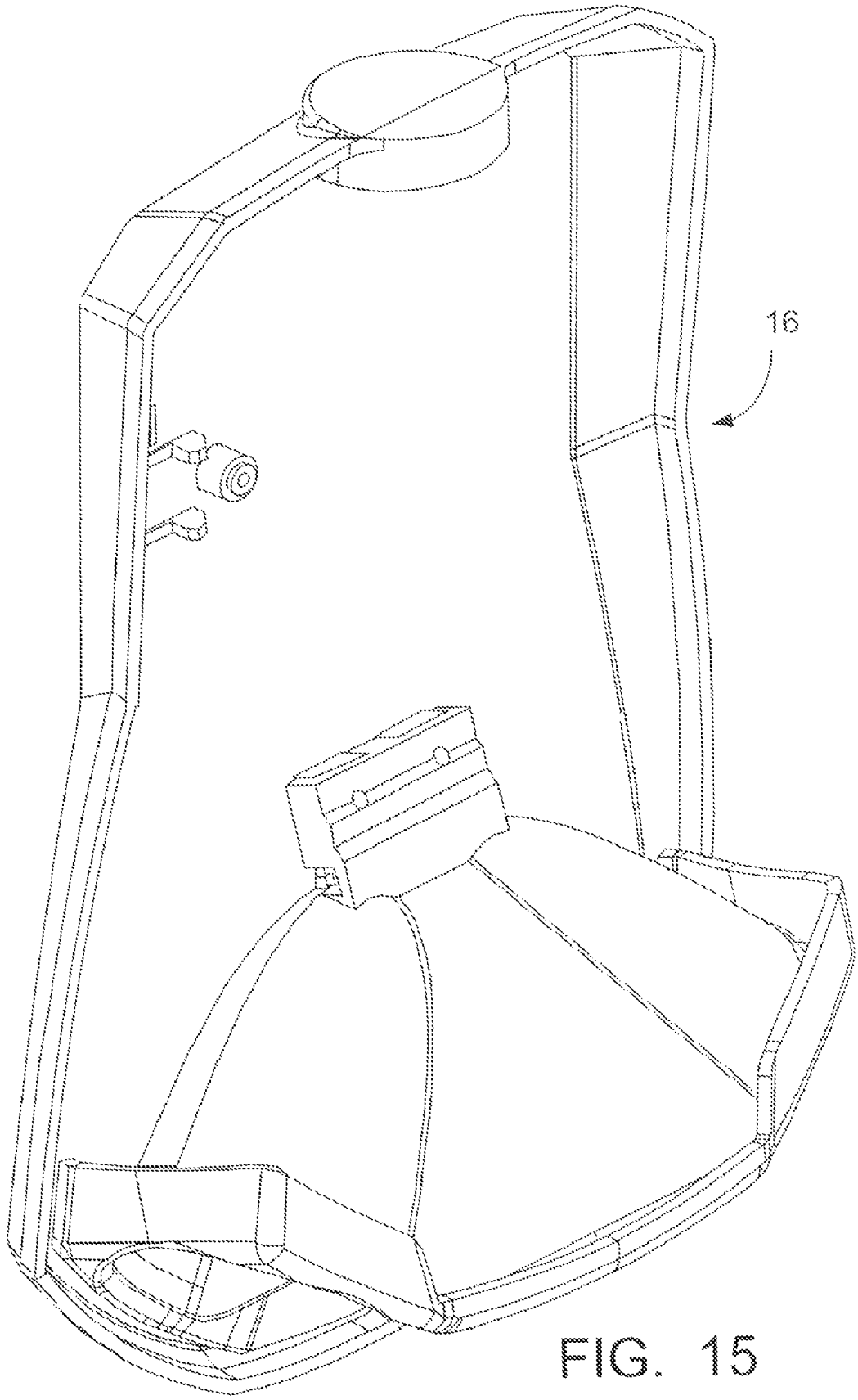

FIG. 11 shows how typical emergency lighting units work. Two lamps with symmetrical beams are oriented to provide an asymmetrical composite beam, much like trying to fit a circular shape in a rectangular area. The present invention preferably fits a rectangular shape in a rectangular area.

FIGS. 12 to 15 show how the present invention has been integrated in the emergency light fixture 16 in accordance with the present invention.

Figure 16:
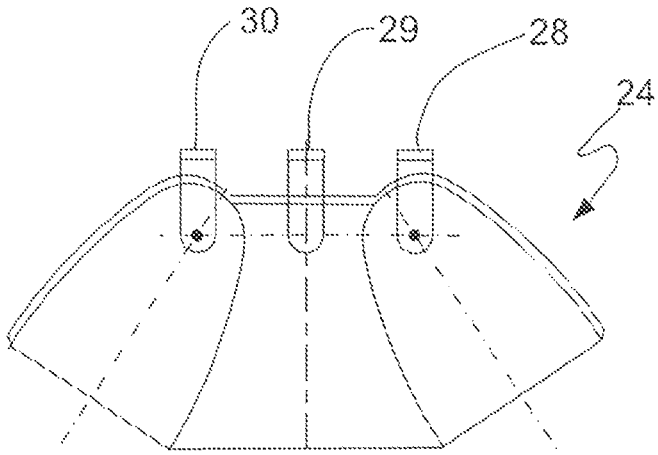
FIG. 16 shows another embodiment of the emergency light fixture with three (3) light sources.

FIG. 16 shows another embodiment with three (3) light sources, 28, 29, and 30. When the target spacing between units is more than thirty (30) feet, for an eight (8)-foot mounting height, it becomes difficult to generate a uniform light pattern. Thus, a third lamp 29 can be added in the center to overcome the spacing problem.

Figure 17:
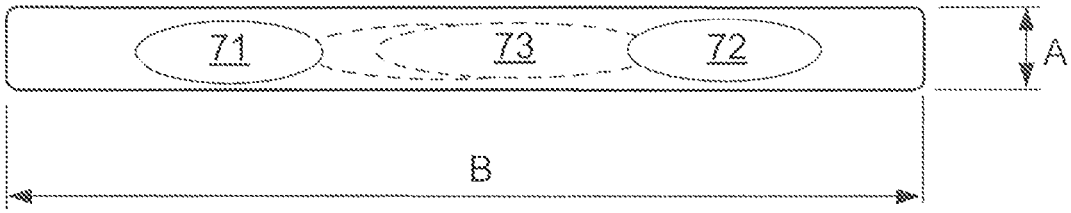
FIG. 17 shows a light pattern generated by the three-light source reflector shown in FIG. 16.
Figure 18B:
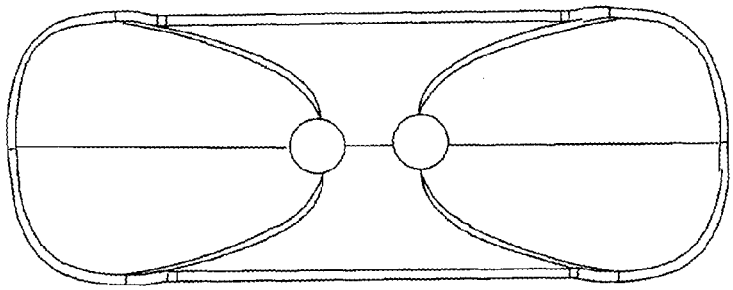
FIGS. 18*a*-*d* show various views of a reflector for use in the emergency light fixture of the present invention, in which surfaces S1 and S2 are not generated by rotation of a parabola around an optical axis.
Figure 18D:
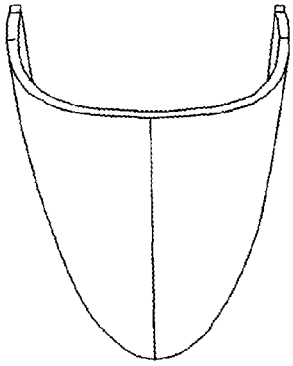
Figure 18C:
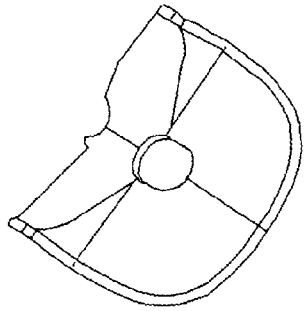
Figure 18A:
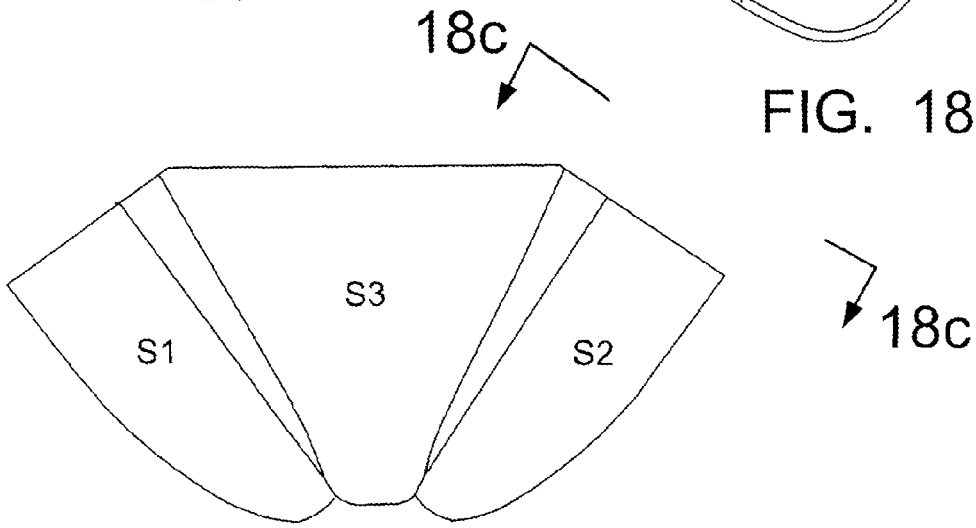
Figure 19B:
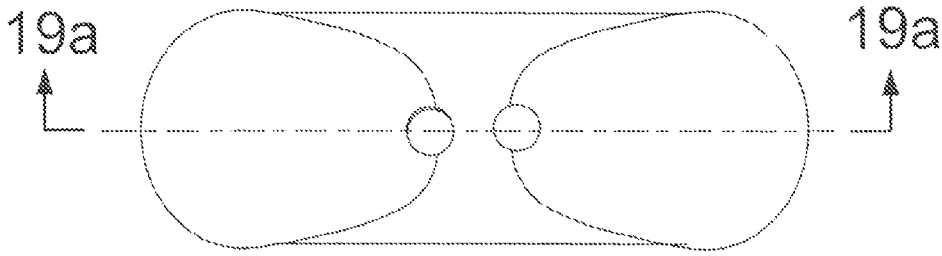
FIGS. 19*a*-*e* show various views of a preferred reflector for use in the emergency light fixture of the present invention, in which surfaces S1 and S2 are generated by rotation of a parabola around an optical axis.
Figure 19D:
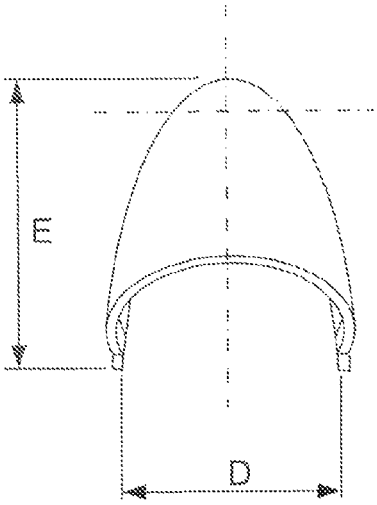
Figure 19E:
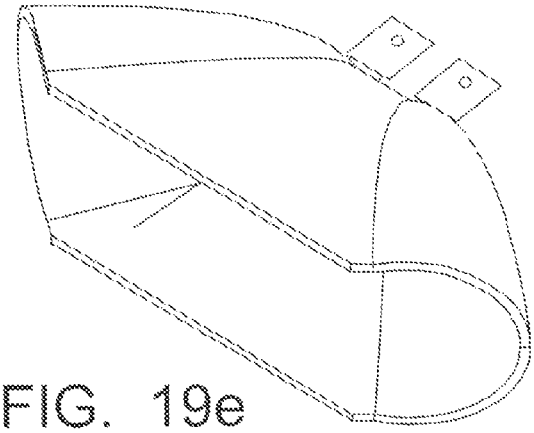
Figure 19A:
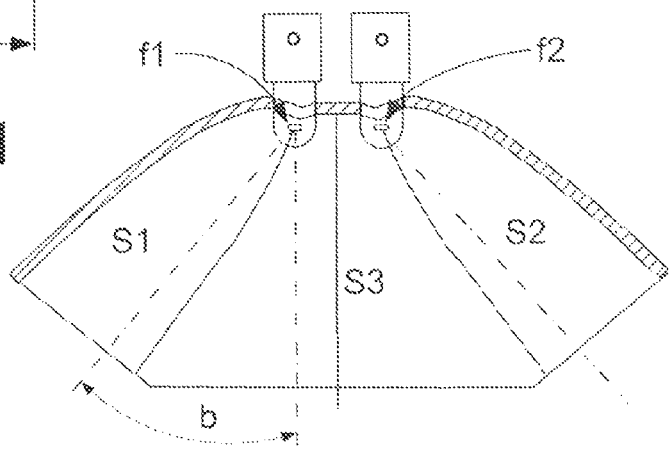
Figure 19C:
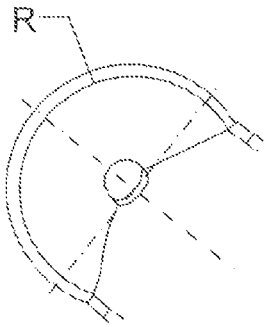

FIG. 17 shows the light pattern generated by a three-light source reflector 24, presented in FIG. 16. The third lamp 29 preferably fills the dimmer zone Z3, between zones Z1 and Z2. Zones Z1 and Z2 represent the brighter spots generated by lamps 28 and 30.

FIGS. 18*a-d* show various views of an embodiment of the reflector for use in the emergency light fixture, in accordance with the present invention, in which surfaces S1 and S2 are not developed by rotation around an optical axis.

FIGS. 19*a-e* show the preferred embodiment of the reflector for use in the emergency light fixture, in which surfaces S1 and S2 are developed by rotation around an optical axis.

The following modifications are intended to be within the scope of the present invention:

1. A light reflector as described above, with the surfaces based on degenerated parabolas. One can control the width of the illuminated path by uniformly degenerating the parabola curves, with larger or smaller openings.
2. A light reflector as described above, with the position of lamps offset a certain distance from the focus of the parabolas, as shown in FIG. 6*b*.
3. A light reflector as described above, with a non-parabolic profile, as shown in FIGS. 6*c* and 6*d*.
4. A light reflector as described above, including three lamps: two as described above and the third lamp in the center of the reflector, with the filament aligned with the other two lamp filaments, as shown in FIG. 16.
5. A light reflector as described above, with surfaces S1 and S2 not developed by a rotation, as shown in FIG. 18.
6. A light reflector as described above, with a profile of a single-segment curve defined by a polynomial, quadratic, or conical function; or a multiple-segment curve defined by line, polynomial, quadratic, or conical function.

The advantages of the present invention include an increased utilization of the reflector surface, a uniform distribution pattern, such that the fixture does not need a diffusing lens, a lower level of light absorption, and consequently an improved light efficacy due to the preferred use of a clear lens in the fixture. The present invention is efficient, compact, and has optimal control of the light in all directions.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A light fixture comprising:

a reflector including a first concave surface having a first axis, a second concave surface having a second axis and a third concave surface that translates along a substantially straight line to intersect the first concave surface and the second concave surface;

a first light source disposed within the reflector in proximity to the first axis to provide a plurality of first light rays, a first portion of the first light rays reflected from the first concave surface across the first axis and a second portion of the first light rays that are not reflected from the first concave surface; and a second light source disposed within the reflector in proximity to the second axis to provide a plurality of second light rays, a first portion of the second light rays reflected from the second concave surface across the second axis and a second portion of the second light rays that are not reflected from the second concave surface, the first portion of the first light rays and the first portion of the second light rays contributing to an interior lighted portion of a lighted pathway that is defined by a combination of the first light rays and the second light rays.

2. The light fixture as defined by claim 1, wherein the the first and second light sources are disposed at the foci or offset from the foci of the first and second concave surfaces.

3. The light fixture as defined by claim 1, wherein the first and second axes are oriented at symmetrical angles with respect to and divergent from a plane bisecting the third concave surface perpendicularly to the substantially straight line.

4. The light fixture as defined by claim 1, further comprising a third light source disposed within the reflector in proximity to a plane bisecting the third concave surface perpendicularly to the substantially straight line, the third light source further being disposed at the foci or offset from the foci of the third concave surface.

5. The light fixture as defined by claim 1, wherein at least one of the first and second concave surfaces is developed by rotation of a curve about its respective axis or is not developed by rotation of a curve about its respective axis.

6. The light fixture as defined by claim 1, wherein at least one of the concave surfaces is at least one of a single-segment concave surface and a multiple-segment concave surface.

7. The light fixture as defined by claim 1, wherein the at least one of the surfaces is defined by at least one of a polynomial, quadratic, conical, and line function.

8. The light fixture as defined by claim 6, wherein a segment of at least one of the concave surfaces is defined by a parabola.

9. The light fixture as defined by claim 1, wherein the concave surfaces form a single cavity.

10. A reflector, the reflector comprising:

a first concave surface having a first axis and a first opening to receive a first light source, the first concave surface configured to reflect first light rays of the first light source from the first concave surface across the first axis and not to reflect second light rays of the first light source from the first concave surface;

a second concave surface having a second axis and a second opening to receive a second light source, the second concave surface configured to reflect first light rays of the second light source from the second concave surface across the second axis and not to reflect second light rays of the second light source from the second concave surface; and a third concave surface that translates along a substantially straight line to intersect the first concave surface and the second concave surface such that the first light rays of the first and second light sources contribute to an interior lighted portion of a lighted pathway that is defined by a combination of the first and second light rays of the first and second light sources.

11. The reflector as defined by claim 10, wherein the first and second axes are oriented at symmetrical angles with respect to a plane bisecting the third concave surface perpendicularly to the substantially straight line.

12. The reflector as defined by claim 10, wherein at least one of the first and second concave surfaces is developed by rotation of a curve about its respective axis or is not developed by rotation of a curve about its respective axis.

13. The reflector as defined by claim 10, wherein at least one of the concave surfaces is at least one of a single-segment concave surface and a multiple-segment concave surface.

14. The reflector as defined by claim 10, wherein the at least one of the surfaces is defined by at least one of a polynomial, quadratic, conical, and line function.

15. The reflector as defined by claim 13, wherein a segment of at least one of the concave surfaces is defined by a parabola.

16. The reflector as defined by claim 10, wherein the concave surfaces form a single cavity.

17. A method of manufacturing a reflector, the method comprising:

providing a first concave having a first axis and a first opening to receive a first light source in proximity to the first axis, the first concave surface configured to reflect first light rays of the first light source from the first concave surface across the first axis and not to reflect second light rays of the first light source from the first concave surface;

providing a second concave surface having a second axis and a second opening to receive a second light source in proximity to the second axis, the second concave surface configured to reflect first light rays of the second light source from the second concave surface across the second axis and not to reflect second light rays of the second light source from the second concave surface;

providing a third concave surface that translates along a substantially straight line to intersect the first concave surface and the second concave surface such that the first light rays of the first and second light sources contribute to an interior lighted portion of a lighted pathway that is defined by a combination of the first and second light rays of the first and second light sources.

18. The method as defined by claim 17, wherein the first and second axes are provided at symmetrical angles with respect to and divergent from a plane bisecting the third concave surface perpendicularly to the substantially straight line.

19. The method as defined by claim 17, wherein at least one of the first and second concave surfaces is developed by rotation of a curve about its respective axis or is not developed by rotation of a curve about its respective axis.

20. The method as defined by claim 17, wherein at least one of the concave surfaces is at least one of a single-segment concave surface and a multiple-segment concave surface.

21. The method as defined by claim 17, wherein the at least one of the surfaces is defined by at least one of a polynomial, quadratic, conical, and line function.

22. The method as defined by claim 20, wherein a segment of at least one of the concave surfaces is defined by a parabola.

23. The method as defined by claim 17, wherein the concave surfaces are provided such that they form a single cavity.

24. The method as defined by claim 17, wherein third concave surface has a third axis and a third opening to receive a third light source in proximity to the third axis, the third axis being perpendicular to the substantially straight line.

* * * * *